US011272785B2

(12) United States Patent
Choi

(10) Patent No.: US 11,272,785 B2
(45) Date of Patent: Mar. 15, 2022

(54) DRAWER SLIDE DEVICE HAVING RETAINERS RESTORED TO RIGHT POSITION

(71) Applicant: TOPSCO CO., LTD., Gwangju (KR)

(72) Inventor: Jengon Choi, Damyang-gun (KR)

(73) Assignee: TOPSCO CO., LTD., Gwangju (KR)

( * ) Notice: Subject to any disclaimer, the term of this patent is extended or adjusted under 35 U.S.C. 154(b) by 0 days.

(21) Appl. No.: 17/061,196

(22) Filed: Oct. 1, 2020

(65) Prior Publication Data

US 2021/0145176 A1 May 20, 2021

(30) Foreign Application Priority Data

Nov. 19, 2019 (KR) ..... 10-2019-0149150
Jun. 5, 2020 (KR) ..... 10-2020-0068169

(51) Int. Cl.
*A47B 88/493* (2017.01)
*A47B 88/477* (2017.01)

(52) U.S. Cl.
CPC ..... *A47B 88/493* (2017.01); *A47B 88/477* (2017.01); *A47B 2210/0018* (2013.01); *A47B 2210/0032* (2013.01); *A47B 2210/0059* (2013.01)

(58) Field of Classification Search
CPC ..... A47B 88/477; A47B 88/493
USPC ..... 312/334.8, 334.11
See application file for complete search history.

(56) References Cited

U.S. PATENT DOCUMENTS 3,904,254 A * 9/1975 Hagen ..... F16C 29/048 384/18
4,469,384 A * 9/1984 Fler ..... A47B 88/493 312/333
6,379,045 B1 * 4/2002 Cirocco ..... H05K 7/1489 312/334.11
6,382,751 B1 * 5/2002 Chiu ..... A47B 88/487 312/334.11
7,946,666 B2 * 5/2011 Huang ..... A47B 88/493 312/333
2017/0254586 A1 * 9/2017 Hwang ..... A47B 88/493

FOREIGN PATENT DOCUMENTS

KR 10-2015-0119995 A 10/2015

* cited by examiner

*Primary Examiner* — James O Hansen
(74) *Attorney, Agent, or Firm* — Heedong Chae; Lucem, PC

(57) ABSTRACT

The present invention relates to a slide device in which retainers provided between an outer rail, an intermediate rail, and an inner rail are guided to be placed at right positions when a drawer is opened or closed, thereby inducing a smooth movements of the rails. According to the slide device of the present invention, openings (312*a* and 130*a*) are formed at least in a second retainer locking step (312) and a second retainer deviation prevention step (130), respectively.

2 Claims, 11 Drawing Sheets

-Prior Art-

DRAWER SLIDE DEVICE HAVING RETAINERS RESTORED TO RIGHT POSITION

BACKGROUND OF THE INVENTION

1. Field of the Invention

The present invention relates to a sliding device for a drawer with an outer rail, an intermediate rail, an inner rail, and retainers respectively installed therebetween, and more particularly, to a slide device to solve a malfunction of the drawer due to a slip of the retainer by providing, when the drawer is closed, a mechanism for restoring an abnormal position of a retainer due to a ball slip of the retainer often occurring when the drawer is opened or closed.

2. Description of the Related Art

In general, sliding type storage members are provided to be opened and closed in a sliding manner in bodies of furniture, refrigerators, or various utility boxes and used to store necessary objects.

The sliding type storage member is installed in a body having a storage member installation space, and opened and closed by slide devices installed between inner wall surfaces of both sides of the installation space and both side surfaces of the storage member so as to be slidably movable by reciprocal rolling contact.

FIG. 1 shows a conventional slide device. As shown in the drawings, the slide device serves as a mechanism for guiding movements of a drawer C when the drawer C positioned in a drawer receiving portion B provided in a home appliance such as a refrigerator is withdrawn from the drawer receiving portion B or inserted into the drawer receiving portion B.

The above slide device includes an inner rail 81 fixed to an outer surface of the drawer C, an outer rail 83 fixed to an inner surface of the drawer receiving portion B, an intermediate rail 82 inserted into the outer rail 83 and receiving the inner rail 81, a first retainer 84 provided between the inner rail 81 and the intermediate rail 82 to guide and support the inner rail 81 when the inner rail 81 is withdrawn from or inserted to the intermediate rail 82, and a second retainer 85 provided between the intermediate rail 82 and the outer rail 83 to guide and support the intermediate rail 82 when the intermediate rail 82 is withdrawn from or inserted to the outer rail 83.

Accordingly, when a user withdraws the drawer C inserted into the drawer receiving portion B, the intermediate rail 82 is configured to be withdrawn from the outer rail 83 due to rolling motions of balls accommodated in the second retainer while being supported by the second retainer 85, and the inner rail 81 is configured to be withdrawn from the intermediate rail 82 due to rolling motions of balls accommodated in the second retainer while being supported by the first retainer 84. The first retainer and the second retainer are moved by ½ of moving distances of the withdrawn intermediate rail and inner rail unless a ball slip occurs.

However, since a slip in a retainer occurs due to sudden pulling or eccentric pulling, inertia upon closing, a gap between adjacent rails, and the like when the user pulls out the drawer, the first retainer 84 and the second retainer 85 may be gradually deviated from right positions. Accordingly, a smooth operation of a rail-type slide device cannot be expected in that, for example, the degree of opening of the drawer is limited, or the drawer is not smoothly opened or closed.

To solve the above problems, Korean Unexamined Patent Publication No. 10-2017-0104316 (RAIL DEVICE AND REFRIGERATOR HAVING THE SAME), and Korean Patent Registration No. 10-1896077 (SLIDER HAVING INNER RETAINER WITH LIMITED MOVABILITY) are disclosed.

All of those are technologies proposed to limit a moving distance of a retainer, in which a moving groove is formed on a fixed rail and an elastic protrusion is formed on a second retainer so as to be moved only within the moving groove, which limit only the moving distance of the second retainer other than a first retainer. Further, since the second retainer is just prevented from being deviated from the right position too much and the retainer deviated from a right position cannot be returned to the right position, the problems cannot be fundamentally solved.

(Patent Document 1) Korean Patent Registration No. 10-1896077 (Aug. 31, 2018. SLIDER HAVING INNER RETAINER WITH LIMITED MOVABILITY)

(Patent Document 2) Korean Unexamined Patent Publication No. 10-2017-0104316 (Sep. 15, 2017. RAIL DEVICE AND REFRIGERATOR HAVING THE SAME)

SUMMARY OF THE INVENTION

The present invention provides a slide device for restoring abnormal positions of all retainers to original states when a drawer is closed.

The present invention provides a slide device that allows a drawer to be always opened or closed smoothly and naturally by returning first and second retainers to right position even when slips occur in the first and second retainers and the first and second retainers are deviated from the right position.

The drawer slide device of the present invention is configured such that a moving protrusion and a stopper for moving a first retainer (400) and a second retainer (500), which are deviated from right positions in the process of operating a drawer to a closed position, to the right positions are provided in a body of each of an outer rail, an inner rail, and an intermediate rail. In the closed position of the drawer, the retainer moving protrusion serves as a mechanism for pushing the retainer to the right position when the retainer does not reach the right position, and the retainer stopper serves as a mechanism for blocking the retainer to stop at the right position when the retainer passes the right position.

Specifically, the drawer slide device of the present invention includes:

an outer rail (100) fixed to a side of a drawer receiving portion in a moving direction of the drawer; an inner rail (200) fixed to a side of the drawer in the moving direction of the drawer so as to be inserted to or withdrawn from the drawer receiving portion; an intermediate rail (300) inserted and moved inside the outer rail (100) and inserted and moved inside the inner rail (200); a first retainer (400) installed between the inner rail (200) and the intermediate rail (300) to guide movements of the inner rail (200); and a second retainer (500) installed between the outer rail (100) and the intermediate rail (300) to guide movements of the intermediate rail (300).

Preferably, the intermediate rail, the outer rail, and the second retainer provided therebetween may be provided as a set, a second retainer moving protrusion (340), which pushes the second retainer (500) to a right position when the drawer is closed, protrudes from a front side of a body (310) of the intermediate rail (300) toward the second retainer (500), a second retainer locking step (312), which pushes the second retainer (500) when the drawer is opened, protrudes from a rear end of the body (310) of the intermediate rail (300) toward the second retainer (500), a second retainer stopper (140), which stops the second retainer (500) at the right position when the drawer is closed, protrudes from a rear side of a body (110) of the outer rail (100) toward the second retainer (500), and a second retainer deviation prevention step (130), which blocks a deviation of the second retainer (500) when the drawer is opened, protrudes from a front end of the body (110) of the outer rail (100) toward the second retainer (500), in which openings (312*a* and 130*a*) are formed at least in the second retainer locking step (312) and the second retainer deviation prevention step (130), respectively, so that the second retainer is restored to the right position.

In addition, the inner rail, the intermediate rail, and the first retainer provided therebetween may be provided as a set, a first retainer moving protrusion (240) may protrude from the inner rail body (210) toward the first retainer (400) to push the first retainer (400) when the first retainer (400) fails to reach the right position, a first retainer stopper (330), which stops the first retainer (400) at the right position when the drawer is closed, may protrude from an inner surface of a rear end side of a flange (320) of the intermediate rail (300) toward both sides of the first retainer (400), and a first retainer deviation prevention step (314), which blocks a deviation of the first retainer (400) when the drawer is opened, may protrude from a front end of the body (310) of the intermediate rail (300) toward the first retainer 400, so that a position of the first retainer may be returned to an initial state when the inner rail and the intermediate rail overlap each other when the drawer is closed.

Meanwhile, an opening may be formed in the deviation prevention step or the locking step of the rail to prevent interference with the moving protrusion and the stopper.

The present invention configured as described above provides a slide device in which all retainers are restored to right positions while the drawer is moved from an opened state to a closed state, wherein both of the first and second retainers are returned to right positions when the drawer is closed even when an error occurs in a position of the retainer due to a slip occurring between the rail and the retainer when the drawer is opened, thereby facilitating exact and constant opening and closing operations of the drawer, so that the usability as well as the reliability of a product can be improved, and thus the product competitiveness can be increased over other products.

DETAILED DESCRIPTION OF THE INVENTION

Hereinafter, a slide device having retainers restored to right positions according to an exemplary embodiment of the present invention will be described in detail with reference to the accompanying drawings.

The slide device according to the present invention is generally provided on both sides of a drawer receiving portion and a drawer so as to serve to guide smooth operations for insertion and withdrawal of the drawer while supporting the drawer with respect to the drawer receiving portion.

Figure 1:
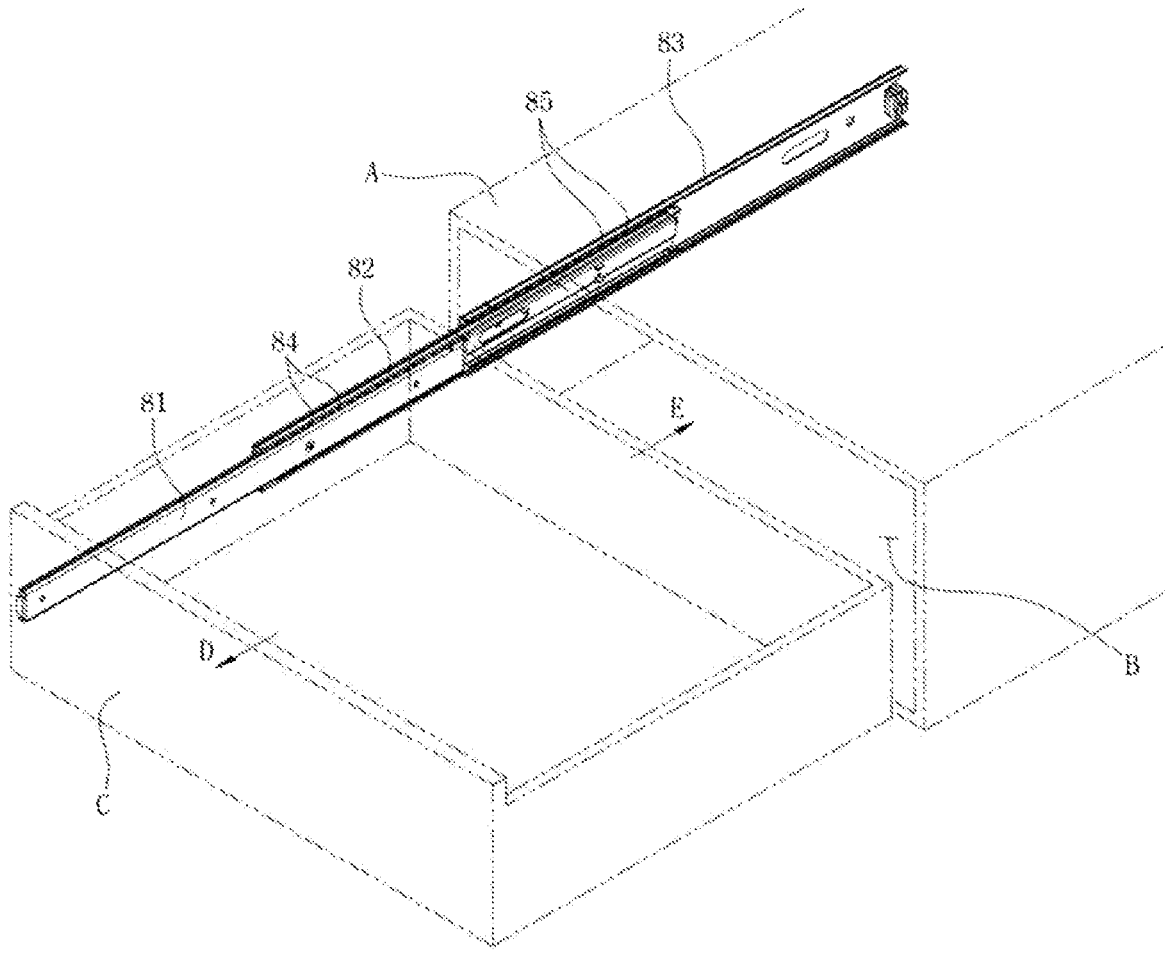
FIG. 1 is a view showing an installation state of a general slide device.

Like a general slide device as shown in FIG. 1, the slide device includes an outer rail 100 fixed to the drawer receiving portion, an inner rail 200 fixed to the drawer provided to be inserted to or withdrawn from the drawer receiving portion, an intermediate rail 300 provided between the outer rail 100 and the inner rail 200, a first retainer 400 provided between the inner rail 200 and the intermediate rail 300 to guide and support movements of the inner rail 200, and a second retainer 500 provided between the outer rail 100 and the intermediate rail 300 to guide and support movements of the intermediate rail 300.

The slide device including the outer rail, the intermediate rail, the inner rail, and the first and second retainers interposed therebetween has the same structure as a known slide device, and the slide device according to the present invention has a feature in that the first and second retainers are restored from an abnormal positions to normal positions when the drawer is closed, so that smooth operations of the drawer can be guided.

The inner rail, the intermediate rail, and the first retainer provided therebetween constitute an inner rail set, and the intermediate rail, the outer rail, and the second retainer provided therebetween constitute an outer rail set.

Each of the rails is expanded to move the drawer to an opened position, and the expanded rails overlap each other to move the drawer to a closed position. According to the opening and closing operations of the drawer, the inner rail set is moved inside the intermediate rail and the outer rail set is moved outside the intermediate rail.

In the slide device of the present invention, an opening direction of the drawer, that is, an end of the rail positioned outside the drawer receiving portion is referred to as a front end part, and a closing direction of the drawer, that is, an end of the rail positioned inside the drawer receiving portion is referred to as a rear end part.

Since the general structures of the outer rail, the inner rail, the intermediate rail, the first retainer and the second retainer are well known, and will be briefly described below.

The outer rail 100 includes an outer rail body 110 and outer rail flanges 120 formed to face each other on both sides of the outer rail body 110. The intermediate rail 300 is relatively moved in a longitudinal direction while being seated inside the outer rail flanges 120, the intermediate rail 300 similarly includes an intermediate rail body and intermediate rail flanges 320 formed to face each other on both sides of the intermediate rail body, and the inner rail 200 is relatively moved in the longitudinal direction while being accommodated inside the flanges of the intermediate rail 300.

Similarly, the inner rail 200 includes an inner rail body 210 and inner rail flanges 220 formed to face each other on both sides of the inner rail body 210.

The second retainer and the first retainer are sequentially inserted between the outer rail and the intermediate rail and between the intermediate rail and the inner rail, in which a plurality of balls are provided so that rolling motions of the balls allow the intermediate rail to be moved in both directions with respect to the outer rail, and the inner rail to be moved in both directions with respect to the intermediate rail.

Figure 2:
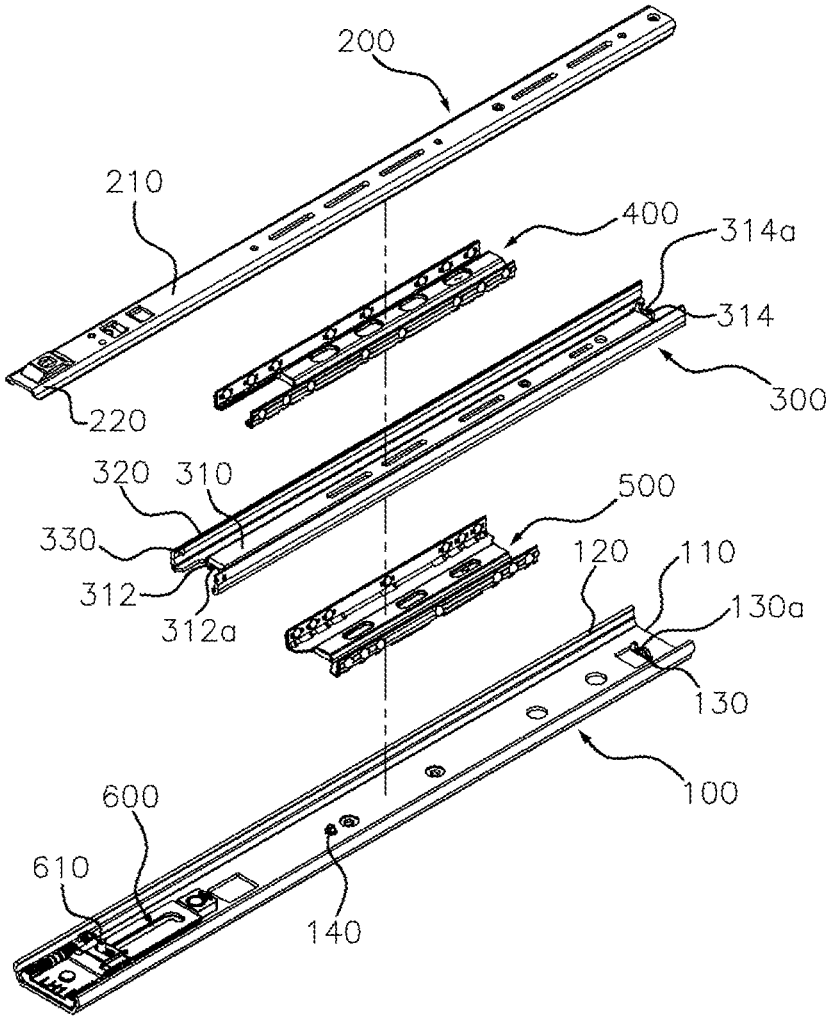
FIG. 2 is an exploded perspective view of a slide device according to a second embodiment of the present invention.
Figure 3:
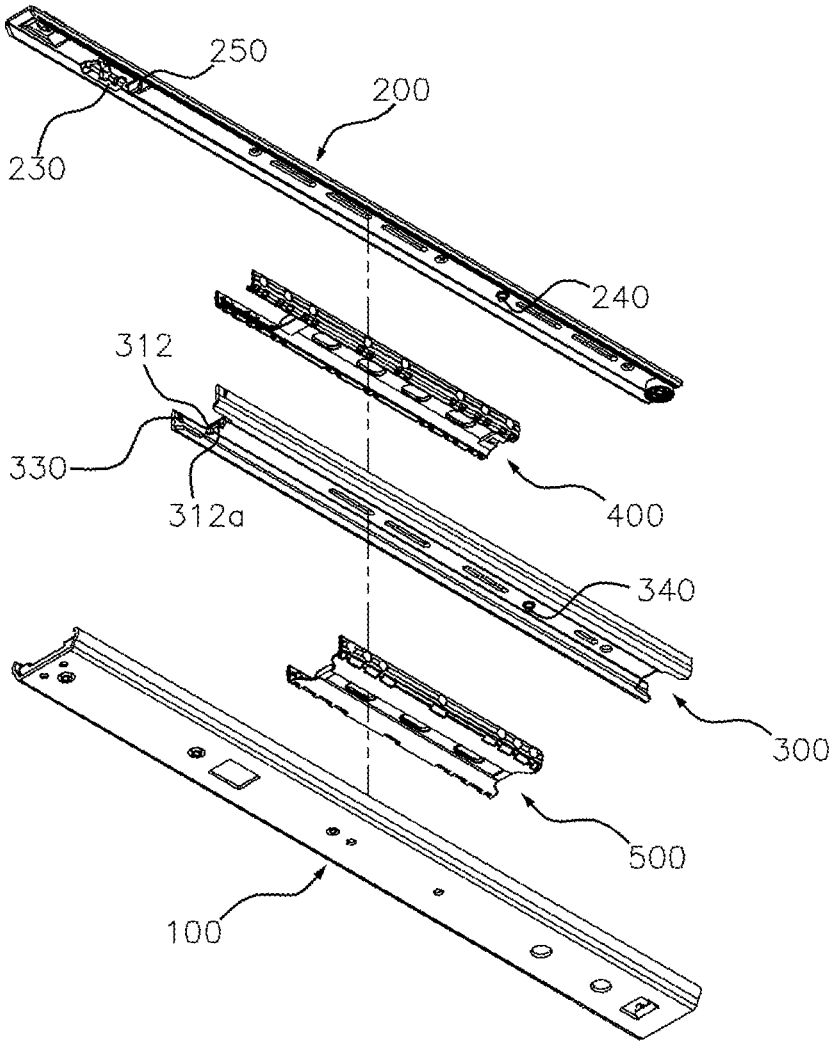
FIG. 3 is an exploded perspective view when viewed from the bottom of FIG. 2.

However, according to the present invention, as shown in the first embodiment of FIGS. 2 and 3, a second retainer deviation prevention step 130 may be formed at a front end part of the outer rail body 110 toward the second retainer 500 so that the second retainer 500 is prevented from being separated from the outer rail 100 when the drawer is opened, a second retainer locking step 312 may be bent from a rear end part of the intermediate rail body 310 toward the second retainer 500, and a first retainer deviation prevention step 314 may be formed at a front end part of the intermediate rail body 310 toward the first retainer. In addition, a first retainer locking step 250 is formed at a rear end part of the inner rail body 210 toward the first retainer.

Both of the first retainer deviation prevention step 314 of the intermediate rail and the second retainer deviation prevention step 130 of the outer rail prevent the first retainer and the second retainer from being separated from the front end parts of the intermediate rail and the outer rail, respectively, when the drawer is fully open, that is, in a state in which the inner rail and the intermediate rail are fully expanded and maximally extend with respect to the outer rail.

In addition, the first retainer locking step 250 of the inner rail 200 and the second retainer locking step 312 of the intermediate rail 300 are configured to push the first and second retainers from the back when the drawer is fully opened, and push the first and second retainers up to the first retainer deviation prevention step 314 and the second retainer deviation prevention step 130, thereby pressurizing the retainers so as to be moved to right positions.

Figure 4:
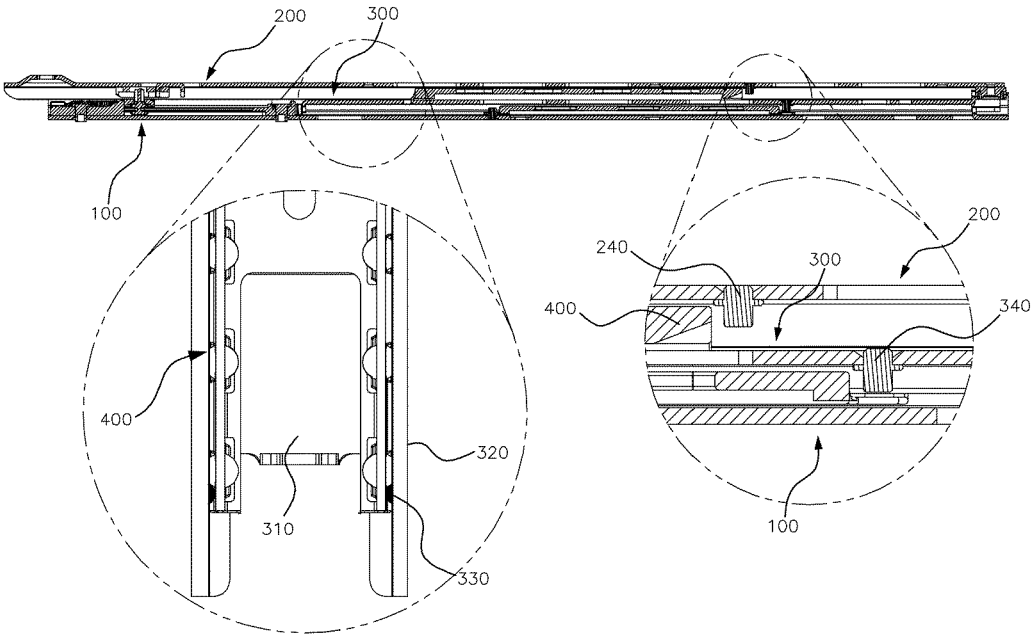
FIG. 4 is a sectional view showing the slide device in a state in which a drawer is fully closed according to a first embodiment of the present invention.
Figure 5:
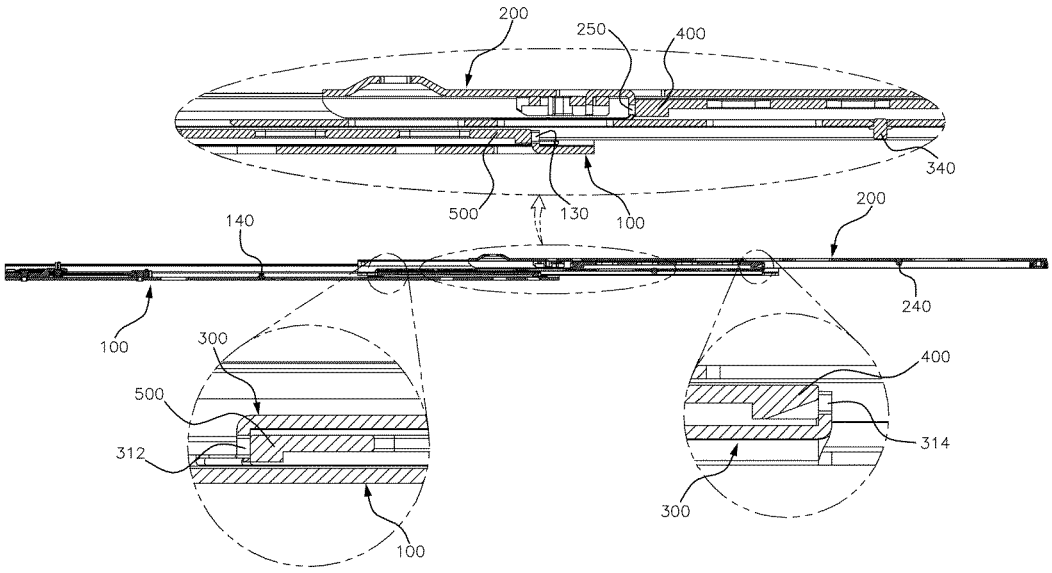
FIG. 5 is a sectional view showing the slide device in a state in which the drawer is fully opened according to the first embodiment of the present invention.

Operations of the deviation prevention steps and the locking steps will be described in detail with reference to FIGS. 4 and 5.

When the drawer is fully opened, the front end parts of the first retainer 400 and the second retainer 500 stop by the first retainer deviation prevention step 314 of the intermediate rail 300 and the second retainer deviation prevention step 130 of the outer rail 100, and the rear end parts of the retainers are pressurized by the locking steps formed in the inner rail 200 and the intermediate rail 300, so that the retainers are disposed at right positions while the drawer is fully opened. However, since users have a tendency to unintentionally and incompletely open the drawer and close the drawer after taking out or putting in an object in the half-open state, the drawer is closed after a slip occurs at the retainer balls, thereby causing a malfunction of the drawer. The invention according to the present invention provides a mechanism for allowing each retainer to stop at right position even when the drawer is closed.

Further, in the process of operating the drawer to the closed position the drawer slide device of the present invention is provided with a moving mechanism and a stopping mechanism for moving the first retainer 400 and the second retainer 500 deviated from the right positions to the right positions, in which the retainer moving protrusion serves as a mechanism for pushing the retainer to the right position when the retainer does not reach the right position in the closed position of the drawer, and the retainer stopper serves as a mechanism for blocking the retainer to stop at the right position when the retainer passes the right position.

Preferably, as a moving mechanism, the inner rail body 210 is provided with a first retainer moving protrusion 240 toward the first retainer, and the intermediate rail body 310 is provided with a second retainer moving protrusion 340 toward the second retainer. The moving protrusions 240 and 340 push the first retainer and the second retainer to the right positions while coming into contact with the first retainer and the second retainer that are deviated from the right positions and fail to reach the right positions in the process of retracting the inner rail with the intermediate rail.

In addition, as a stopping mechanism, a first retainer stopper 330 is provided on an inner surface of a rear end of the flange 320 of the intermediate rail toward both sides of the first retainer, and a second retainer stopper 140 is provided on the outer rail body 110 toward the second retainer. Particularly, the first retainer stopper 330 provided on both inner surfaces of the rear end of the flange of the intermediate rail may be formed by caulking processing, and may be formed as a protrusion on the inner side of the flange in other manners.

The stoppers 330 and 140 come into contact with the first retainer and the second retainer passing the right positions and deviated from the right positions in the process of retracting the intermediate rail with the outer rail, thereby stopping the movements.

For each of the retainers, positions of the moving protrusions and the stoppers are set on each body of the outer rail, the inner rail, and the intermediate rail under the assumption that the slip does not occur. Preferably, the moving protrusions and stoppers may be formed on each of the rail bodies while having a gap of about 2 mm as a predetermined clearance from the right positions of the retainers. Accordingly, the moving protrusions and stoppers come into contact with the retainers only when the retainers are deviated from the right positions, thereby serving to return the retainers to the original positions.

Exemplary operations of the movable protrusions and the stoppers according to the first embodiment will be described.

In a closed state of the drawer, that is, when the rails are completely retracted, the second retainer stopper 140 is configured to be formed on a rear side of the outer rail body 110 and come into contact with the rear end of the second retainer so as to function as a stopping mechanism for preventing the second retainer from being deviated from the right position and passing the right position, and the first retainer stopper 330 is configured to be formed on an inner surface side of the rear end of the intermediate rail flange 320 and come into contact with an outer surface of the rear end of the first retainer so as to function as a stopping mechanism for preventing the first retainer from being deviated from the right position and passing the right position.

Likewise, in the closed state of the drawer, the second retainer moving protrusion 340 is configured to be formed on a front side of the intermediate rail body 310 toward the second retainer and come into contact with the front end of the second retainer so as to function as a moving mechanism for pushing the second retainer when the second retainer fails to reach the right position, and the first retainer moving protrusion 240 is configured to be formed on a front side of the inner rail body 210 toward the first retainer and come into contact with the front end of the first retainer so as to function as a moving mechanism for pushing the first retainer when the first retainer fails to reach the right position.

However, the moving protrusions and the stoppers are formed therein with openings not to cause interference with each other while the rails are opened and closed with respect to each other. In other words, since a problem may occur upon opening and closing of the slide device when the movable protrusion or the stopper interferes with the deviation prevention step or the locking step formed in the rails, the opening is formed in each of the interfering deviation prevention step and locking step.

Since the moving protrusions and the stoppers provided in each rail body readily pass the deviation prevention step and the locking step through the openings 130*a*, 312*a* and 314*a* formed in the locking step and the deviation prevention step of the adjacent rail, the rails may be mutually opened and closed.

According to the present invention as described above, the intermediate rail and the inner rail are moved while being stably supported by the first and second retainers, respectively, when the drawer is opened or closed, and the first and second retainers are guided to be placed at the right positions when the drawer is closed even when the retainers are deviated from the right positions due to a slip caused by sudden movements of the intermediate rail and the inner rail, so that the problem caused by the slip of the retainers can be basically solved.

Figure 6:
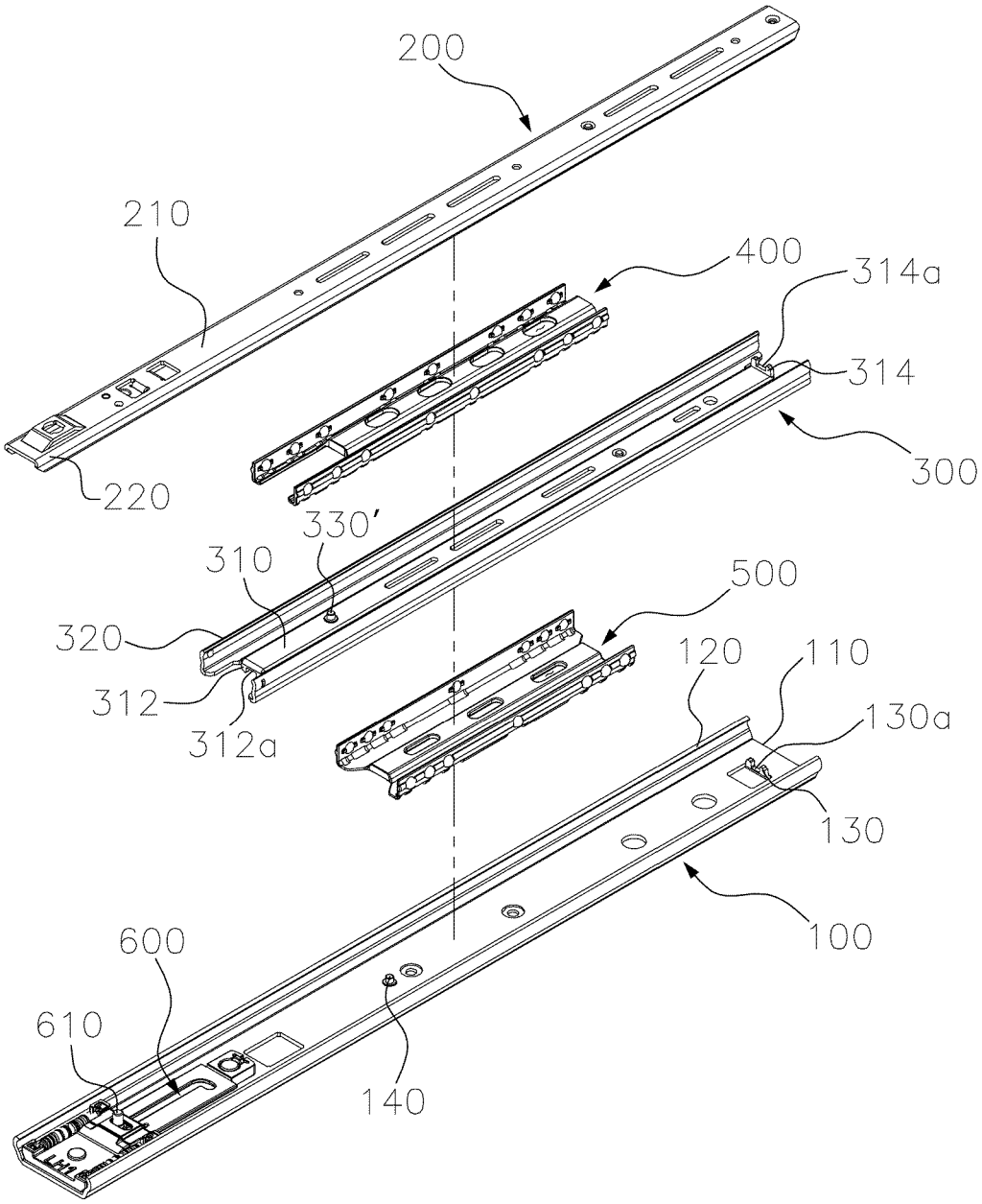
FIG. 6 is an exploded perspective view of a slide device according to a second embodiment of the present invention.
Figure 7:
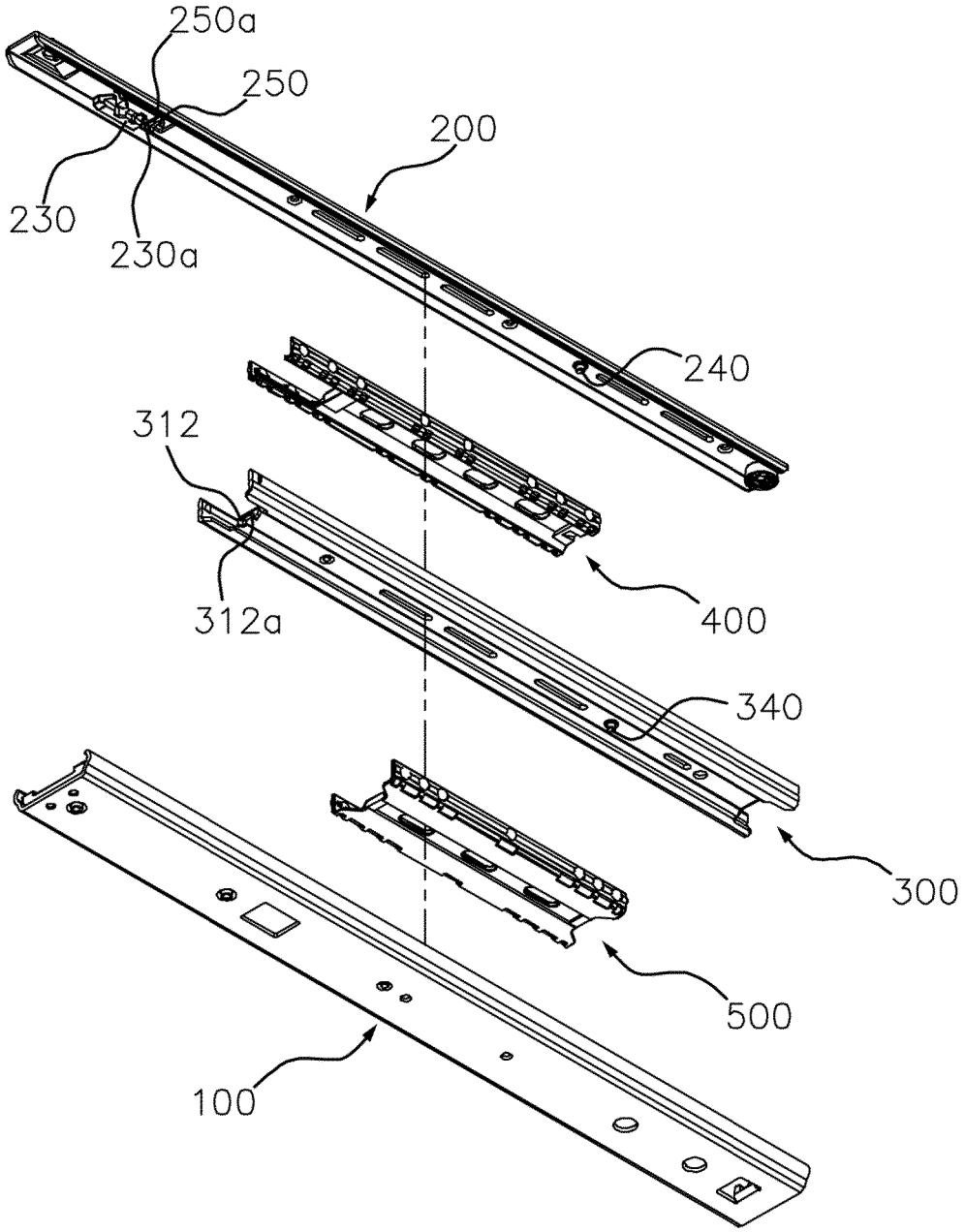
FIG. 7 is an exploded perspective view when viewed from the bottom of FIG. 6.
Figure 8:
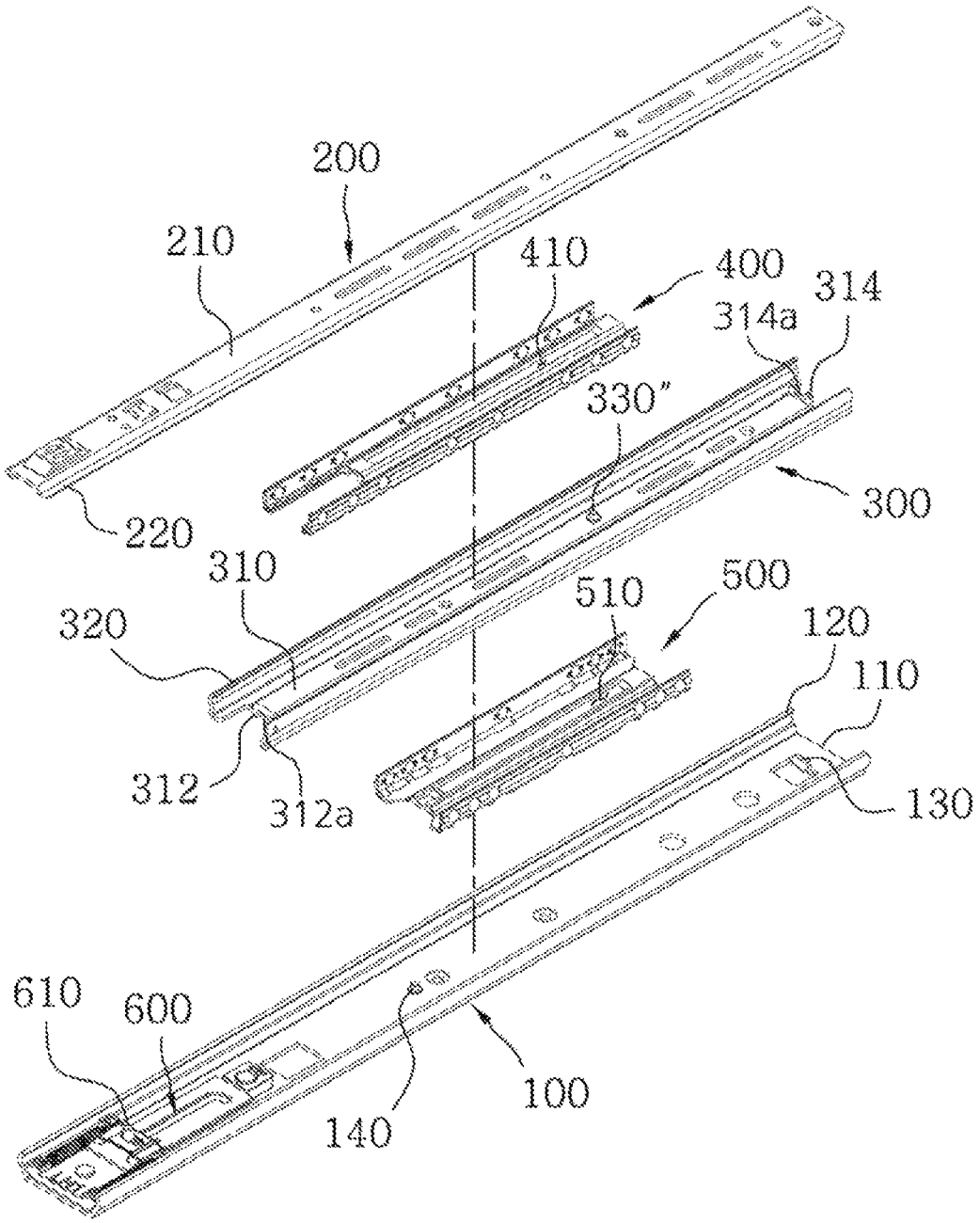
FIG. 8 is an exploded perspective view of a slide device according to a third embodiment of the present invention.
Figure 9:
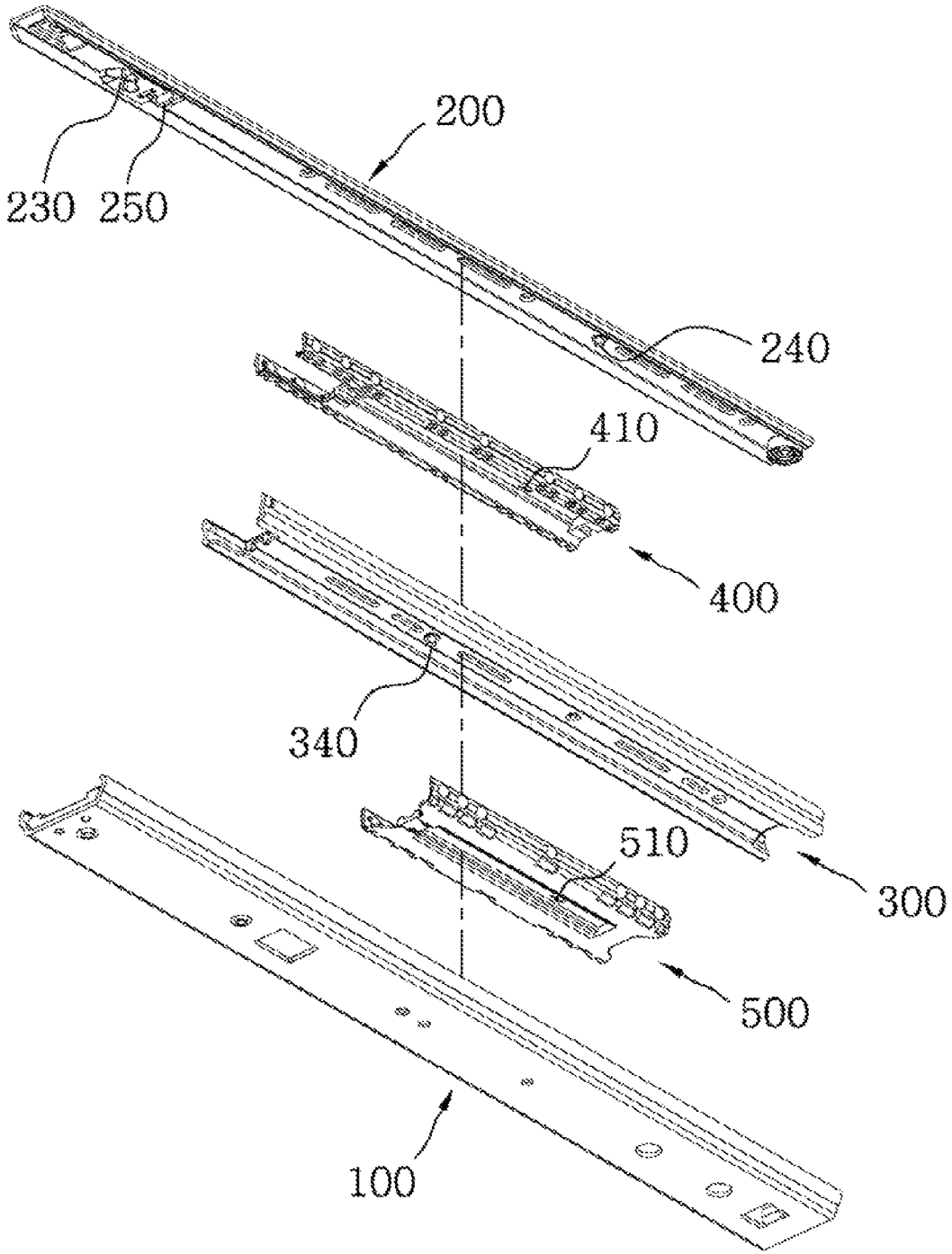
FIG. 9 is an exploded perspective view when viewed from the bottom of FIG. 8.
Figure 10:
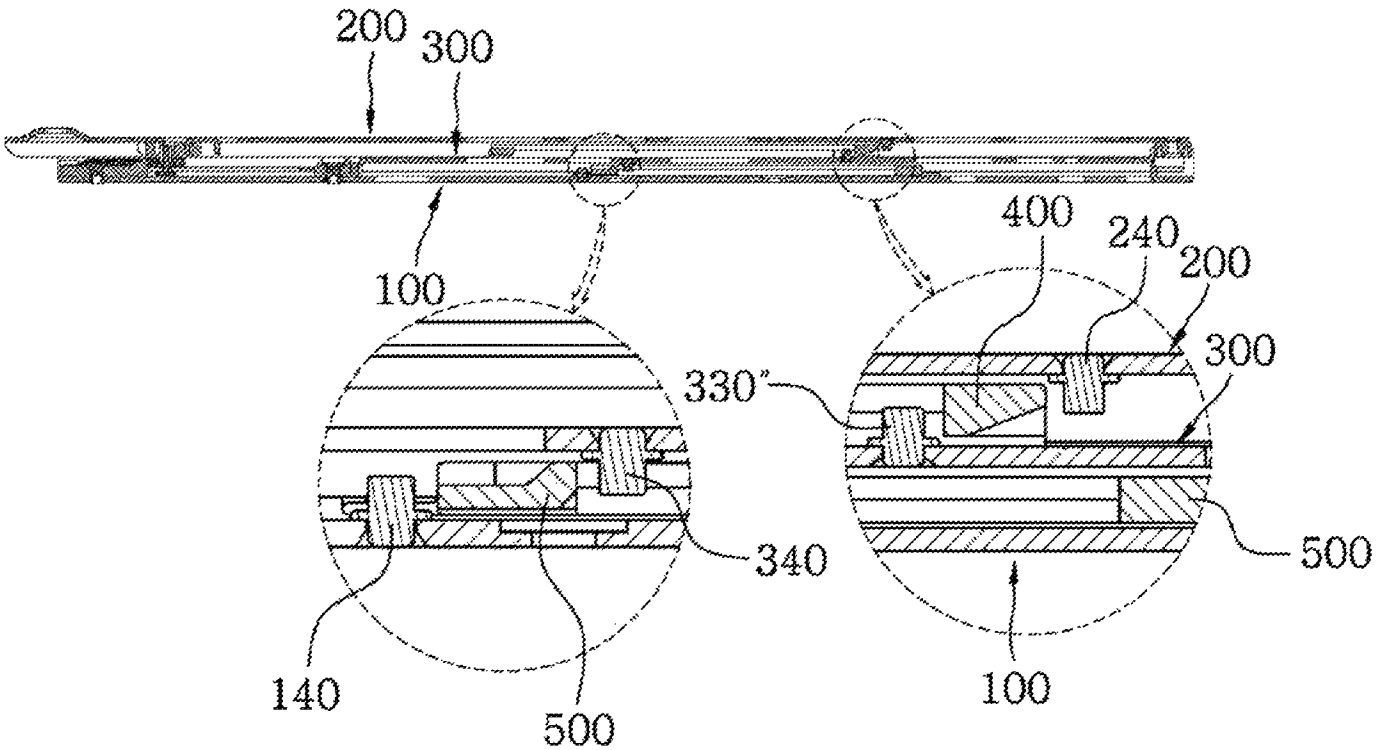
FIG. 10 is a sectional view showing the slide device in a state in which a drawer is fully closed according to the third embodiment of the present invention.
Figure 11:
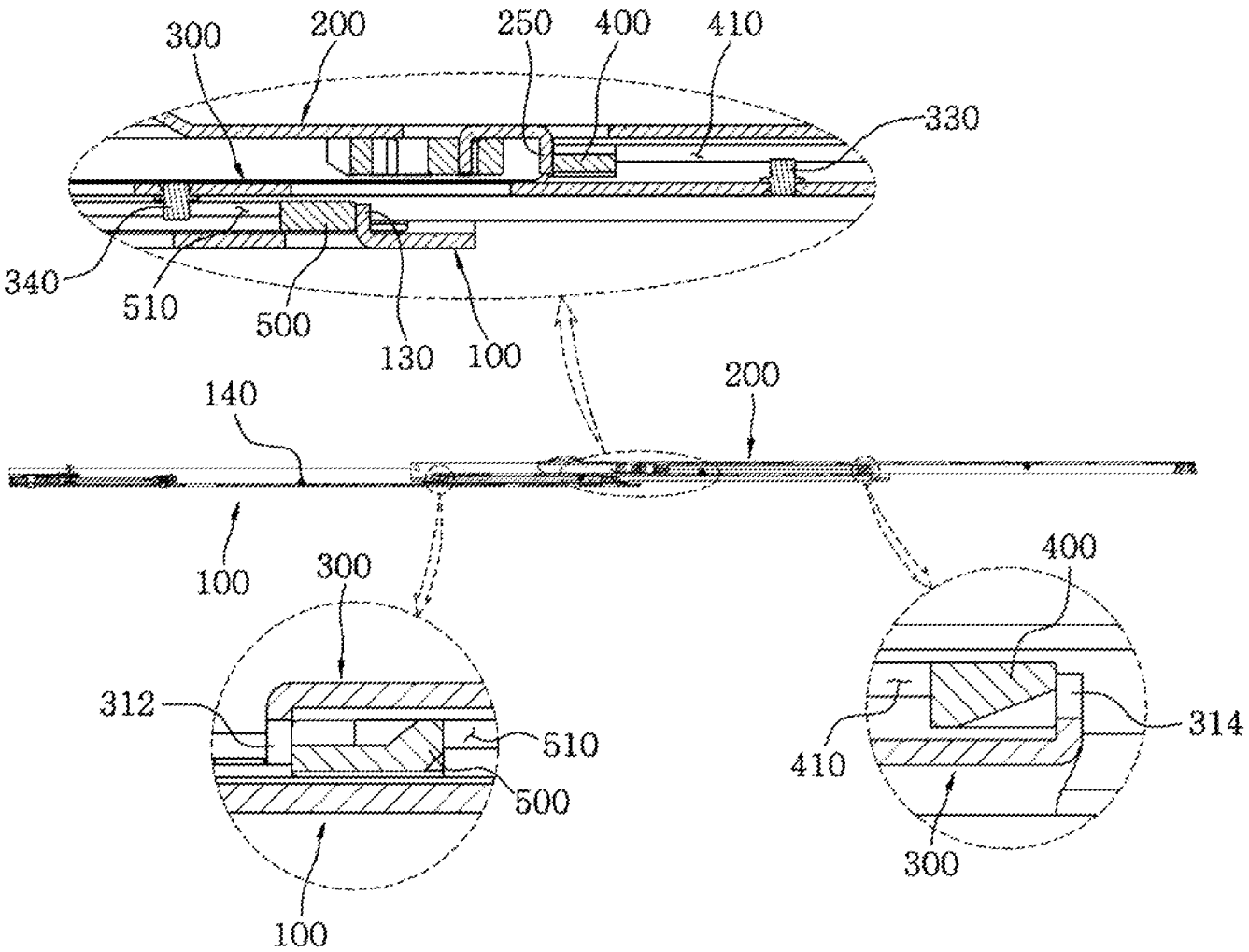
FIG. 11 is a sectional view showing the slide device in a state in which the drawer is fully opened according to the third embodiment of the present invention.

Meanwhile, referring to FIGS. 6 and 7, according to a second embodiment of the present invention, the intermediate rail body 310 is provided with a first retainer stopper 330', as a stopping mechanism, toward the first retainer. In a closed state of the drawer, that is, when the rails are completely retracted, the second retainer stopper 140 is configured to be formed on a rear side of the outer rail body 110 and come into contact with the rear end of the second retainer so as to function as a stopping mechanism for preventing the second retainer from being deviated from the right position and passing the right position, and the first retainer stopper 330' is configured to be formed on a rear side of the intermediate rail body 310 and come into contact with the rear end of the first retainer so as to function as a stopping mechanism for preventing the first retainer from being deviated from the right position and passing the right position.

Since the moving protrusions and the stoppers provided in each rail body may readily pass the deviation prevention step and the locking step through the openings 130*a*, 250*a*, 312*a*, and 314*a* formed in the locking step and the deviation prevention step of the adjacent rail, the rails may be mutually opened and closed. A generally known movable pin guide portion 230 provided at the rear end part of the inner rail may be formed with an opening 230*a* to prevent an interference with the first retainer stopper 330' according to a position of the movable pin guide portion 230.

However, according to the second embodiment of the present invention including the intermediate rail body 310 provided with the first retainer stopper 330' directed toward the first retainer, the first retainer stopper 330' is required to be subject to the riveting process in a state in which the outer rail 100, the inner rail 200, and the intermediate rail 300, the first retainer 400, and the second retainer 500 are coupled together, it is difficult to check the precise position, which is disadvantageous compared to the first embodiment. In other words, since a stopper may be effectively formed at the rear end of the intermediate rail 300 through the caulking processing even while the rail and the retainer are coupled as a set, the first retainer stopper 330' according to the first embodiment is advantageous compared to the second embodiment.

As described above, the present invention may solve the malfunction of the drawer due to the slip of the retainer by providing, when the drawer is closed, a mechanism for restoring an abnormal position of a retainer due to a ball slip of the retainer often occurring when the drawer is opened or closed, through the drawer slide device in which the retainers of the first and second embodiments are restored to right positions.

As a third exemplary embodiment of the present invention, the embodiments shown in FIGS. 8 to 11 are based on the first retainer and the second retainer provided with a first moving guide hole and a second moving guide hole in the longitudinal direction. Preferably, a first moving guide hole 410 may be formed in the first retainer in the longitudinal direction, the first retainer stopper 330" formed on the front side of the intermediate rail body 310 toward the first retainer may be inserted into and moved along the first moving guide hole 410, so that the first retainer stopper 330" adjusts a position of the first retainer so as to be placed at a position between the first retainer moving protrusion and the first retainer stopper 330". In other words, in a completely closed position of the drawer, the first retainer stopper 330" is provided in the intermediate rail body 310 so as to be positioned at a front end of the first moving guide hole.

In addition, a second moving guide hole 510 may be formed in the second retainer in the longitudinal direction, the second retainer moving protrusion 340 formed on the rear side of the intermediate rail body 310 toward the second retainer may be inserted into and moved along the second moving guide hole 510, so that the second retainer stopper 340 adjusts a position of the second retainer so as to be placed at a position between the second retainer stopper 140 and the second retainer stopper 340. In other words, in the completely closed position of the drawer, the second retainer moving protrusion 340 is provided in the intermediate rail body 310 so as to be positioned at a rear end of the second moving guide hole.

A length of the first moving guide hole 410 may be longer than a distance between the first retainer deviation prevention step 314 and the first retainer stopper 330", and a length of the second moving guide hole 510 may be longer than a distance between the locking step 312 and the second retainer moving protrusion 340.

Accordingly, the first retainer stopper 330" and the second retainer moving protrusion 340 may be moved while being guided on the first moving guide hole 410 and the second moving guide hole 510, respectively. Thus, the inner rail and the intermediate rail as well as the first and second retainers may move smoothly, so that the operational reliability of the slide device of the present invention may be increased.

According to the present invention as described above, the intermediate rail and the inner rail are moved while being stably supported by the first and second retainers, respectively, when the drawer is opened or closed, the first and second retainers are guided to be placed at the right positions when the drawer is closed even when the retainers are deviated from the right positions due to a slip caused by sudden movements of the intermediate rail and the inner rail, so that the problem caused by the slip of the retainers can be basically solved.

The inner rail set and the outer rail set may be arbitrarily selected by the user. In the present invention, operating principles of the inner rail set and the outer rail set are substantially the same. Therefore, the design of the present invention may be easily modified in which any one of the inner rail set or the outer rail set may be changed to a generally known rail set.

What is claimed is:

1. A drawer slide device having retainers restored to right position, the drawer slide device comprising:

an outer rail (100) fixed to a side of a drawer receiving portion in a moving direction of a drawer;

an inner rail (200) fixed to a side of the drawer in the moving direction of the drawer so as to be inserted to or withdrawn from the drawer receiving portion;

an intermediate rail (300) inserted and moved inside the outer rail (100) and inserted and moved inside the inner rail (200);

a first retainer (400) installed between the inner rail (200) and the intermediate rail (300) to guide movements of the inner rail (200); and a second retainer (500) installed between the outer rail (100) and the intermediate rail (300) to guide movements of the intermediate rail (300), wherein a first retainer moving protrusion (240), which pushes the first retainer (400) to a right position when the drawer is closed, protrudes from a front of a body (210) of the inner rail (200) toward the first retainer (400), and a first retainer locking step (250), which pushes the first retainer (400) when the drawer is opened, protrudes from a rear end of the body (210) of the inner rail (200) toward the first retainer (400), and a first retainer deviation prevention step (314), which blocks a deviation of the first retainer (400) when the drawer is opened, protrudes from a front end of a body (310) of the intermediate rail (300) toward the first retainer 400, and a first retainer stopper (330), which stops the first retainer (400) at the right position when the drawer is closed, protrudes from an inner surface of a rear end side of a flange (320) of the intermediate rail (300) toward the first retainer (400), in which an opening (314*a*) is formed in the first retainer deviation prevention step (314) such that the retainer moving protrusion (240) passes through the opening (314*a*) when the drawer is opened or closed.

2. The drawer slide device of claim 1, wherein a second retainer moving protrusion (340), which pushes the second retainer (500) to a right position when the drawer is closed, protrudes from a front side of a body (310) of the intermediate rail (300) toward the second retainer (500), and a second retainer locking step (312), which pushes the second retainer (500) when the drawer is opened, protrudes from a rear end of the body (310) of the intermediate rail (300) toward the second retainer (500), and a second retainer stopper (140), which stops the second retainer (500) at the right position when the drawer is closed, protrudes from a rear side of a body (110) of the outer rail (100) toward the second retainer (500), and a second retainer deviation prevention step (130), which blocks a deviation of the second retainer (500) when the drawer is opened, protrudes from the front end of a body (110) of the outer rail (100) toward the second retainer (500), in which openings (312*a* and 130*a*) are formed in the second retainer locking step (312) and the second retainer deviation prevention step (130).

* * * * *